US009592933B1

(12) United States Patent
Campbell

(10) Patent No.: US 9,592,933 B1
(45) Date of Patent: Mar. 14, 2017

(54) GIFT CONTAINER WITH INSERT FOR EJECTING PARTICULATE MATERIAL

(71) Applicant: Derek Jorge Campbell, Lexington, KY (US)

(72) Inventor: Derek Jorge Campbell, Lexington, KY (US)

( * ) Notice: Subject to any disclaimer, the term of this patent is extended or adjusted under 35 U.S.C. 154(b) by 0 days.

(21) Appl. No.: 15/147,497

(22) Filed: May 5, 2016

Related U.S. Application Data

(60) Provisional application No. 62/158,573, filed on May 8, 2015.

(51) Int. Cl.
*B65D 33/00* (2006.01)
*B65D 33/12* (2006.01)
*B65B 7/16* (2006.01)

(52) U.S. Cl.
CPC ..... *B65D 33/004* (2013.01); *B65B 7/16* (2013.01); *B65D 33/12* (2013.01)

(58) Field of Classification Search
CPC .. B65D 33/004; B65D 33/12; B65D 33/1691; A45C 15/00
See application file for complete search history.

(56) References Cited

U.S. PATENT DOCUMENTS 4,377,917 A 3/1983 Guidry
4,787,160 A * 11/1988 Balsamo ..... B65D 73/0092 206/469
5,199,745 A * 4/1993 Balsamo ..... G09F 1/04 206/469
5,263,890 A * 11/1993 Dent, IV ..... G09F 1/04 40/124.06
6,146,018 A 11/2000 Keller et al.
7,322,134 B2 1/2008 Cheek et al.
8,955,240 B1 2/2015 Loftus
2002/0185202 A1* 12/2002 Ho ..... B65D 5/4291 150/106
2003/0111521 A1* 6/2003 Holmes ..... B65D 5/0254 229/117
2004/0198503 A1* 10/2004 Fairweather ..... B42D 15/045 472/52
2006/0062494 A1* 3/2006 Aptekar ..... B65D 33/12 383/40
2006/0086014 A1 4/2006 Plank et al.
2006/0196787 A1 9/2006 Lewis
2007/0133195 A1* 6/2007 Gorton ..... A45C 15/06 362/156
2007/0201772 A1* 8/2007 Schindele ..... B65D 33/004 383/40

(Continued)

OTHER PUBLICATIONS https://www.youtube.com/watch?v=npdxyKXevow Published on Jan. 15, 2015.

(Continued)

*Primary Examiner* — Gary Hoge
(74) *Attorney, Agent, or Firm* — KIng & Schickli, PLLC

(57) ABSTRACT

An apparatus for containing a gift includes an outer container, such as a gift bag, having an opening for receiving the gift and an insert, such as a flexible packet, for containing a particulate material. The insert is adapted for attaching to the outer container to release the particulate material upon opening of the outer container to retrieve the gift. Related methods are disclosed.

17 Claims, 5 Drawing Sheets

(56) References Cited

U.S. PATENT DOCUMENTS

| | | | | |
|---|---|---|---|---|
| 2009/0050505 | A1* | 2/2009 | Rubin | B42D 15/045 206/459.5 |
| 2012/0033897 | A1* | 2/2012 | Lahr Yoder | B65D 33/004 383/6 |
| 2013/0334080 | A1* | 12/2013 | Campbell | B65D 31/08 206/232 |
| 2014/0033651 | A1* | 2/2014 | Cunningham | B42D 15/042 53/411 |
| 2015/0210434 | A1* | 7/2015 | Miller | B65D 31/12 383/40 |
| 2015/0314921 | A1* | 11/2015 | Mayer | B42D 15/045 383/6 |
| 2015/0336714 | A1* | 11/2015 | Talbot | B42D 15/022 206/457 |

OTHER PUBLICATIONS https://shipyourenemiesglitter.com/product/The-OG-Glitter-Bomb-54 Printed May 5, 2016.
Http://kathhamey.com/explosion-cards/ Posted on Mar. 9, 2012.
http://www.onlinefireworks.com/bombbags.aspx Printed May 5, 2016.

* cited by examiner

GIFT CONTAINER WITH INSERT FOR EJECTING PARTICULATE MATERIAL

This application claims the benefit of U.S. Provisional Patent Application Ser. No. 62/158,573, the disclosure of which is incorporated herein by reference.

TECHNICAL FIELD

This disclosure relates generally to the packaging arts and, more particularly, to a gift container associated with an insert or ejector with a visually pleasing particulate material, such as glitter, that releases when the container is opened to retrieve the gift.

BACKGROUND

The giving of gifts is a common practice, and containers (such as bags) for the delivery of gifts are commonly sold through a variety of venues, including specialty stores, convenience stores, grocery stores, and the like. These containers or bags are often intricately decorated so that the gift bag itself is pleasing to the eye and interesting to the recipient of the gift. Decorations associated with such gift bags are often specific to a given occasion or holiday, such as a birthday, graduation, or Christmas, and typically offer no element of surprise other than may be associated with the presentation of the gift in the bag or container.

This disclosure proposes a container, such as a bag, adapted for ejecting a visually pleasing particulate material, such as glitter, when opened to retrieve a gift contained therein. In one embodiment, the ejection is achieved using an ejector that is easy to implement on existing gift containers or bags, and which provides a reliable manner of achieving an enhanced element of surprise in association with the giving of gifts.

SUMMARY

According to one aspect of the disclosure, an apparatus for containing a gift includes an outer container having an opening for receiving the gift and an insert for containing a particulate material. The insert is adapted for attaching to the outer container so as to release the particulate material upon opening of the outer container to retrieve the gift (that is, movement of the outer container from a closed condition to an open condition). The outer container of the apparatus may be provided in the form of a blank, with or without the insert attached to it.

In one embodiment, the insert is adapted to be attached to an interior surface along an upper portion of a sidewall of the outer container. In this or another embodiment, the insert comprises a sheet adapted to be attached to opposed interior surfaces of the outer container. The sheet forms a compartment for retaining the particulate material prior to the opening of the outer container and for ejecting the particulate material from the compartment upon opening of the outer container. For example, the sheet may include at least one inverted crease. The sheet may be formed of a first material and the outer container formed of a second material, and wherein the first material has a lower tensile strength than the second material.

In this or another embodiment, the outer container comprises a flexible bag having a plurality of sidewalls and a bottom wall opposite the opening, which of course provides the open condition when open and the closed condition when closed. A connector may be provided for connecting the insert to the outer container, such as a bag. In one embodiment, the connector comprises an adhesive on the insert for attaching at least one side of the outer container to the insert. The connector may comprise a strip of double sided tape including a liner covering an adhesive face for adhering the insert to the outer container. The connector may comprise a projection for connecting the outer container to the insert, such that the opening of the outer container causes the projection to release the particulate material from the insert.

According to a further aspect of the disclosure, an apparatus for containing a gift includes an outer container having an opening for receiving the gift in an open condition of the container, and a closed condition where the opening is closed to conceal the gift. An ejector is attached to the outer container and containing a particulate material, the ejector adapted for ejecting the particulate material toward the opening upon movement of opposing sidewalls of the container during movement of the outer container from the closed condition to the open condition to retrieve the gift through the opening.

In one embodiment, the outer container comprises a flexible bag, and the ejector comprises a packet attached to an upper interior portion of the flexible bag. The ejector may be attached to the opposing sidewalls of the outer container along an upper portion thereof. Specifically, a first side of the ejector is attached to at least one of the sidewalls of the outer container, and further including a connector for connecting a second side of the ejector to another sidewall of the outer container. The particulate material may comprise one or more of glitter, confetti, beads, gems, precious stones, semi-precious stones, crystals, or like objects that are of visual interest to a gift recipient.

According to a further aspect of the disclosure, a method of providing a gift comprises, during opening of an outer container including the gift, ejecting a particulate material from an insert within the outer container. The outer container may comprise a flexible bag having an open end and the insert comprises an ejector including the particulate material. The opening of the outer container may comprise separating opposing sidewalls of the flexible bag to which the flexible packet is attached such that the visually appealing content is ejected toward the open end. The method may further include the step of attaching the outer container to the ejector, and still further may include the step of sealing the outer container with the gift and the ejector therein.

This disclosure also pertains to an apparatus for use in connection with a gift bag. The apparatus comprises an insert containing a particulate material and a connector for connecting the insert to the gift bag so as to release the particulate material upon opening of the outer container to retrieve the gift.

BRIEF DESCRIPTION OF THE DRAWINGS

The accompanying drawing figures incorporated herein and forming a part of the specification illustrate several aspects of the aspects of the disclosure, and together with the description serve to explain certain principles thereof.

Reference will now be made in detail to the present preferred embodiments of the systems and methods, examples of which are illustrated in the accompanying drawing figures.

DETAILED DESCRIPTION

Figure 1:
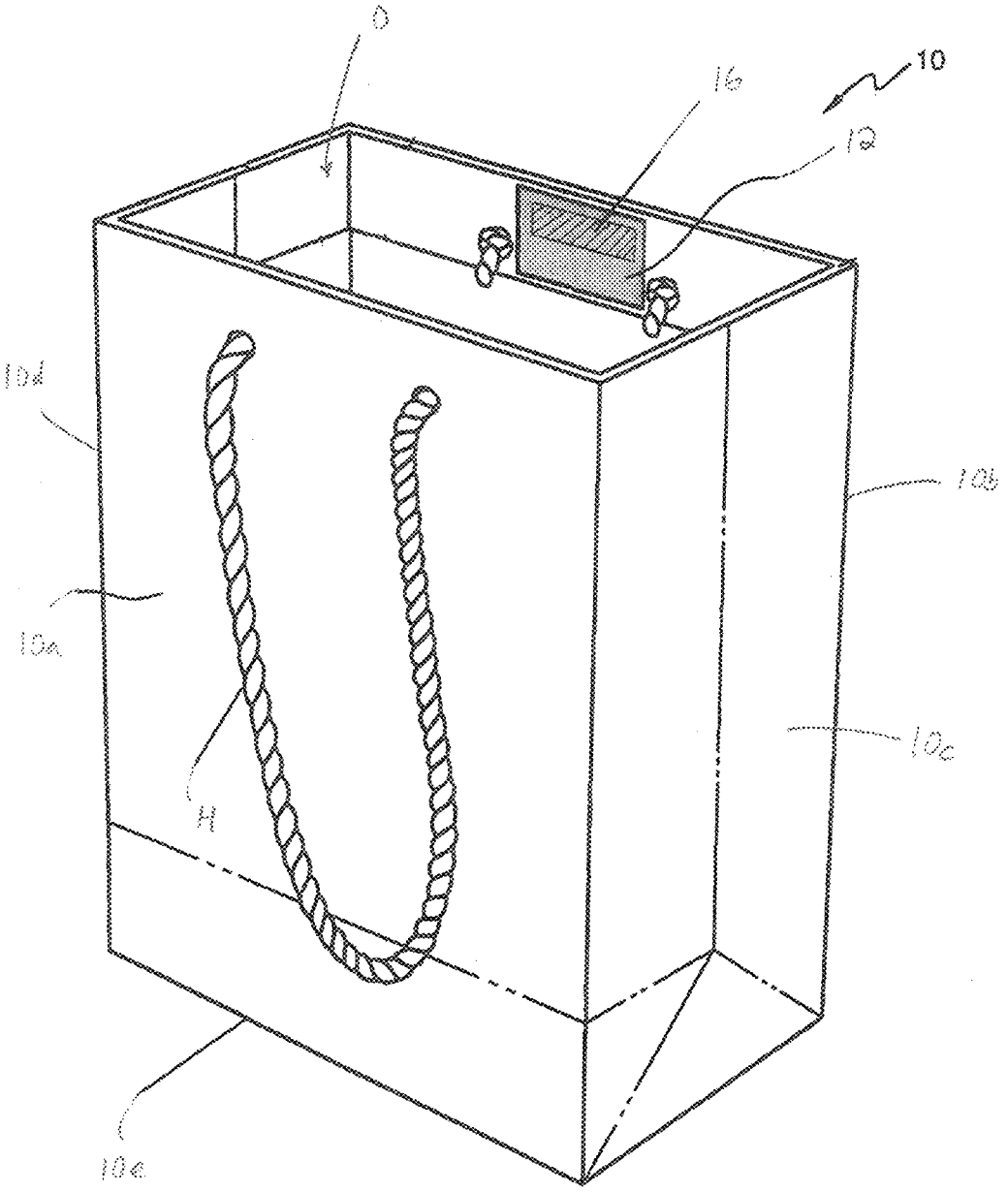
FIG. 1 is a perspective view of a container in the form of a gift bag including an insert or ejector for ejecting a particulate material when the bag is opened to retrieve the gift.
Figure 2:
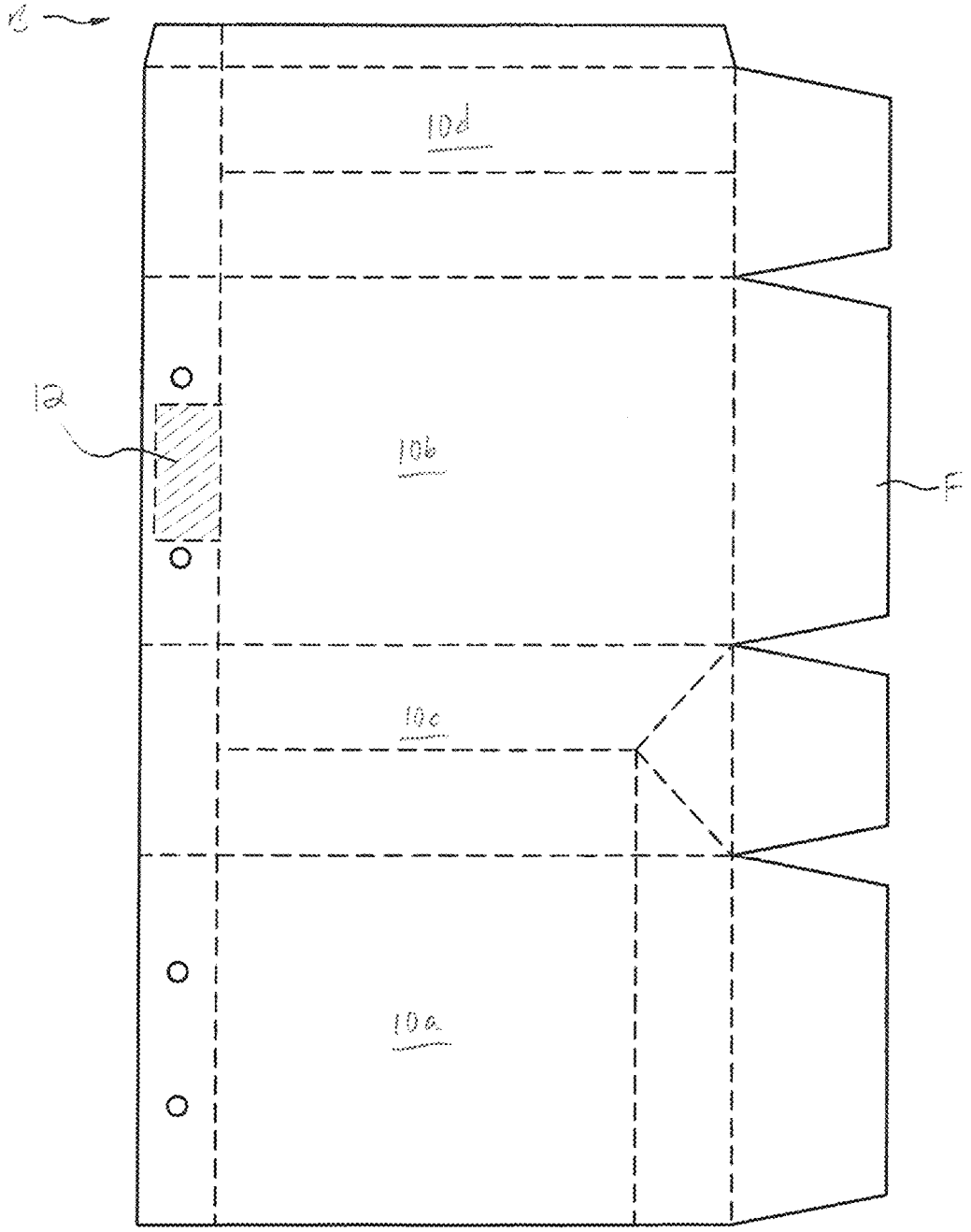
FIG. 2 is a plan view of a blank for forming the bag of FIG. 1.

FIG. 1 illustrates a gift container in the form of a bag 10, which is adapted to receive a gift therein in an open condition and conceal the gift when closed. Specifically, the bag 10 includes an open end O for receiving the gift into an interior compartment defined by at least two spaced sidewalls 10*a*, 10*b* connected by end walls 10*c*, 10*d*, which may be pleated as shown to promote flexing during the opening and closing of the bag 10. The bag 10, and the walls 10*a*-10*e* in particular may be formed of a flexible, disposable material, such as paper, and may be decorated as desired with coloring or other indicia to provide a pleasing visual effect. The vertical sidewalls 10*a*-10*d* may be connected by a bottom wall 10*e*, which is generally opposite the open end O, and supports the gift in use. The bag 10 may be formed of a generally planar blank B, as indicated in FIG. 2, with flaps F closing and being sealed together to form the bottom wall 10*e*. One or more handles H may also be optionally provided, and may be connected to each sidewall 10*a*, 10*b* (such as by passing through apertures formed therein) or other portions of the bag 10 adjacent to the open end O.

According to one aspect of the disclosure, the bag 10 may be considered an outer container that receives and includes an internal container or insert 12 adapted for receiving, containing, and eventually releasing, a visually pleasing substance, such as a particulate material 14, when the bag is opened by a user to retrieve the gift when present in the interior compartment. In one embodiment, this insert 12 or inner container is in the form of a flexible packet adapted to receive and contain the material 14, which may be in the form of glitter, confetti, beads, gems, precious stones, semi-precious stones, crystals, or other small particulate matter. The insert 12 may he sealed, such as with an adhesive, so as to prevent the material 14 from escaping prior to intended use, which may be done prior to being associated with the bag 10.

In one aspect, the insert 12 may be attached to the bag 10. Specifically, in one example, the insert 12 may be attached at one side to an interior surface of one sidewall 10*a*, such as along an upper portion near the open end O, and to the opposite side at sidewall 10*b*. The insert 12 may be attached by a connector, such as an adhesive (glue, a tape strip, etc.) or may form an integral part of the wall(s) 10*a*, 10*b*. In one embodiment, the insert 12 is connected to one wall of the bag 10, such as sidewall 10*b*, during manufacturing (including possibly while in the form of a blank B). For purposes of illustration, the insert 12 is depicted having a width less than the full width of the sidewall 10*a*, 10*b* to which it corresponds when attached, but could be of a larger or smaller width than is shown.

A connector in the form of an adhesive strip 16 may be used for attaching the insert to another wall, such as sidewall 10*a*, of the gift bag 10 when it is being sealed with a gift in an interior compartment thereof. Rather than (or in addition to) an adhesive strip, the connector may take the form of a tether connected both the bag 10 and to the insert 12 for pulling it apart when the bag is opened to a certain extent (anywhere between partially and fully opened, depending on the length of the tether).

Figure 5:
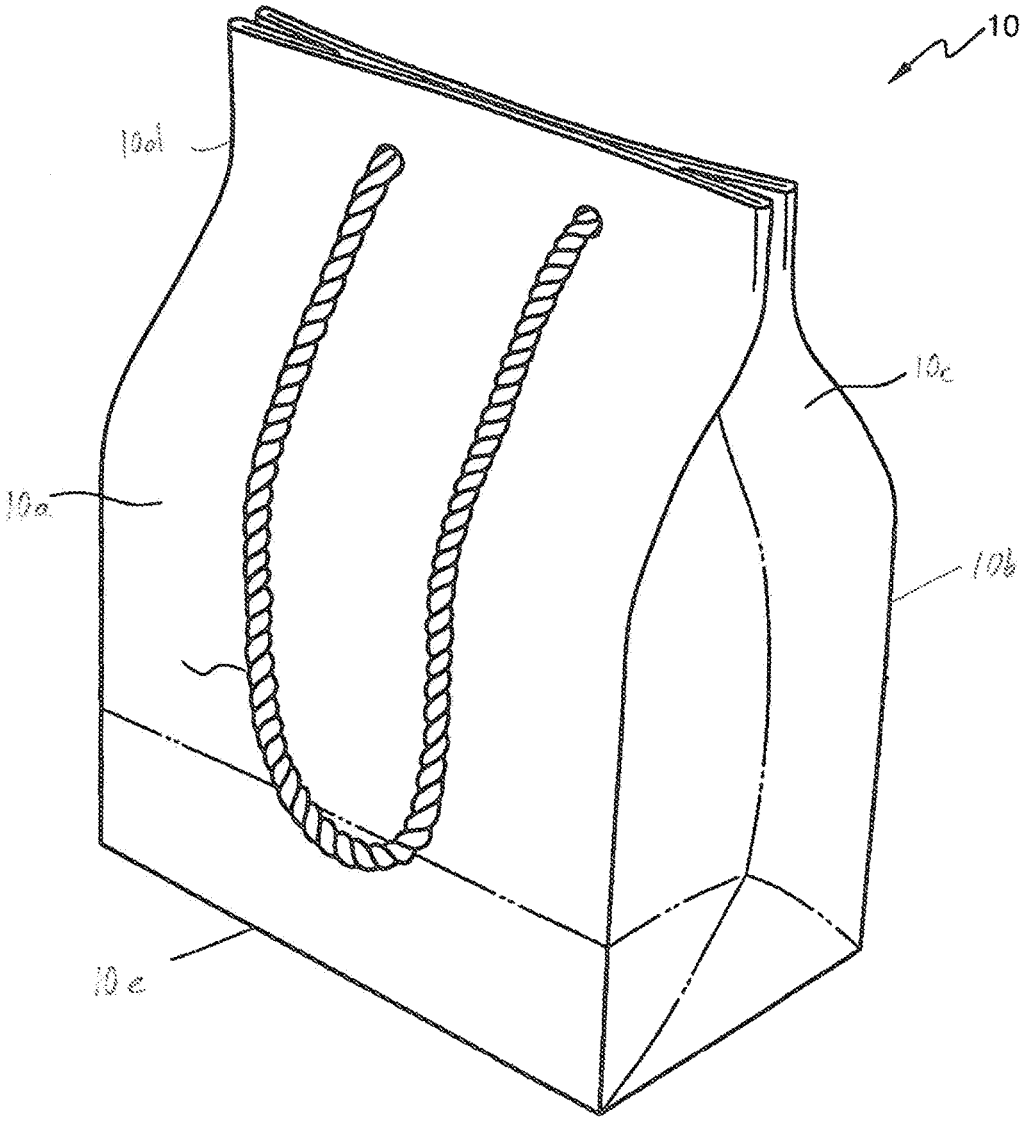
FIG. 5 is a perspective view of the bag of FIG. 1 in a closed configuration.

In any case, when the bag 10 is sealed to conceal the gift therein (see FIG. 5) and opened by a recipient, such as by pulling on handles H to retrieve the gift therein, the movement to the open condition causes the insert 12 to eject the material 14 for visualization by the gift recipient. Specifically, the insert 12 transitions from a closed or substantially sealed configuration as a result of the movement of the sides of the packet forming the insert 12 in opposite directions, which may result in the full or partial destruction of the insert and the detachment of the previously sealed portions of the bag 10, such as sidewalls 10*a*, 10*b*. The concomitant expansion of the packet forming insert 12 ejects the material 14 towards the open end O of the bag 10 and in most cases through it (which will ultimately depend on the circumstance of the pulling force used, the amount of material present, the size of the packet forming insert 12, and the like). This ejection of the material 14, which could be shiny and formed of a variety of colors, provides a surprising and pleasing visual effect to the recipient, which enhances the overall experience associated with delivery of the gift. The insert 12 may thus be considered to form an ejector for the material 14 held therein, since it ejects the material during the opening of the bag 10 to reveal the once-concealed gift therein.

In one particular embodiment, the adhesive strip 16 forming the connector comprises a double sided tape with a temporary (e.g, peel-away) covering or liner on one side (such as the side exposed to the opposite wall of the bag 10 to which the insert 12 is to be connected to complete the assembly). This arrangement allows for the insert 12 to be fully attached to the bag 10 later. Consequently, the purchaser of the bag 10 may add the gift prior to sealing the bag and giving the resulting assembly to the ultimate recipient. Upon removal of the liner or covering from the strip 16 to expose an adhesive face, the insert 12 may be attached to the container or bag 10, such as along sidewall 10*a*, thereby sealing the gift bag 10. Although the adhesive strip 16 is illustrated as attached to the insert 12, an alternate approach is to attach it to a wall of the bag 10, such that removal of the liner allows for attachment to the insert 12 to the strip connected to the wall of the bag 10 in order to complete the assembly.

The gift container such as bag 10 may comprise a different material than the insert 12. For example, the bag 10 may be constructed of a sturdier material (e.g., plastic, or a paper such as a multi-walled or laminated paper) than the insert 12, such that the bag material has a higher tensile strength or burst strength than the tensile strength or burst strength of the material of the insert 12. The insert 12, on the other hand, may be constructed of a weaker or frangible material (such as gossamer paper, tissue paper, or foil), which may more easily rupture or tear than the material of the outer container in which it is placed. In this manner, when the bag 10 is fully assembled and opened by the ultimate gift recipient, the insert 12 may rupture or tear, thereby releasing the material 14, while the bag remains intact for possible reuse (including possibly with a new insert).

Figure 3:
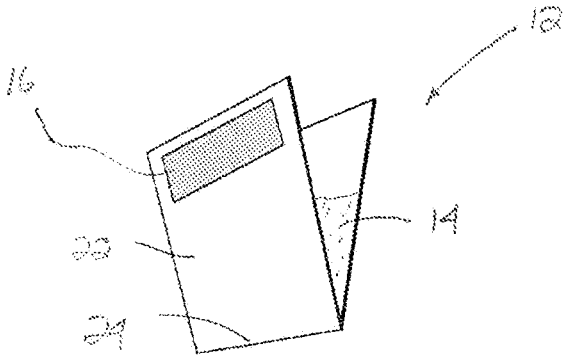
FIGS. 3 and 4 are side views of different embodiments of the insert.

In one embodiment, as shown in FIG. 3, the insert 12 may include a single sheet 22 attached to one wall of the gift bag 10. In this instance, the single sheet 22 may comprise the weaker material adapted to tear, burst, or otherwise rupture with a lower force than the material comprising the bag 10. The single sheet 22 may be sealed to bag 10 to retain the material 14 therebetween. Alternatively, the insert 12 may be formed of a plurality of sheets, such as two sheets of material that are interconnected to form a pouch or pocket that receives the particulate material. While as noted above the assembly may be pre-formed, the sheet 22 and the particulate material 14 may be provided as a kit, with or without the bag, and an adhesive can be used to form the self-contained insert 12 for application to the bag.

In any case, as illustrated in FIG. 3 (with the lateral sides exposed and spaced for purposes of illustration), the insert 12 may include a lower formation in the form of a single inverted, or V-shaped crease 24. As can be appreciated, this crease forms the lower portion of the insert 12 and creates the pocket in which the substance, such as particulate material 14, rests prior to ejection. As the sides of the insert 12 are separated as a result of opening of the bag 10, the crease 24 also moves upward toward the open end of the bag, thus generating the upward propulsion that ejects the material 14 for surprising the gift recipient.

Figure 4:
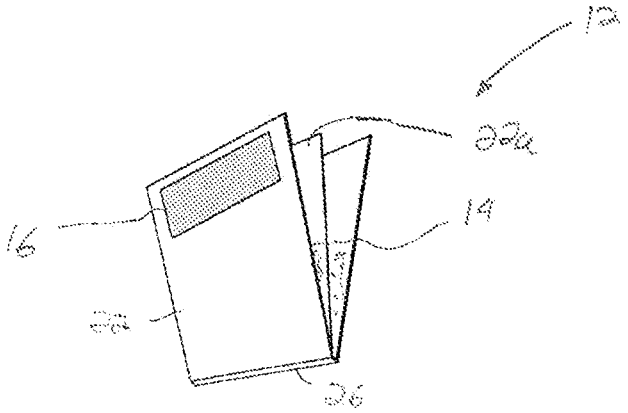

In a further embodiment, as illustrated in FIG. 4, the insert 12 include a lower formation, which may include a double, or W-shaped, crease 26, which may tend to alter the ejection force or trajectory of the material 14. As can be appreciated, this provides the sheet of material 22 with a fold 22*a* (which need not correspond to the full height of the sheet), but again, the insert 12 could also be made from several sheets of material.

As an additional or alternative manner of connecting and/or sealing the insert 12, a hook and loop fastener, such as a Velcro strip, may be used in any of the embodiments described herein. In this manner, the sides of the insert may be attached to each of the two sides of the gift bag 10, with each of the sides of the insert 12 including one of either a hook or loop element (e.g. one side of the Velcro strip on each side of the insert). Upon opening the gift bag 10, the hook and loop fastener may be released, thereby releasing the material 14.

Figure 6:
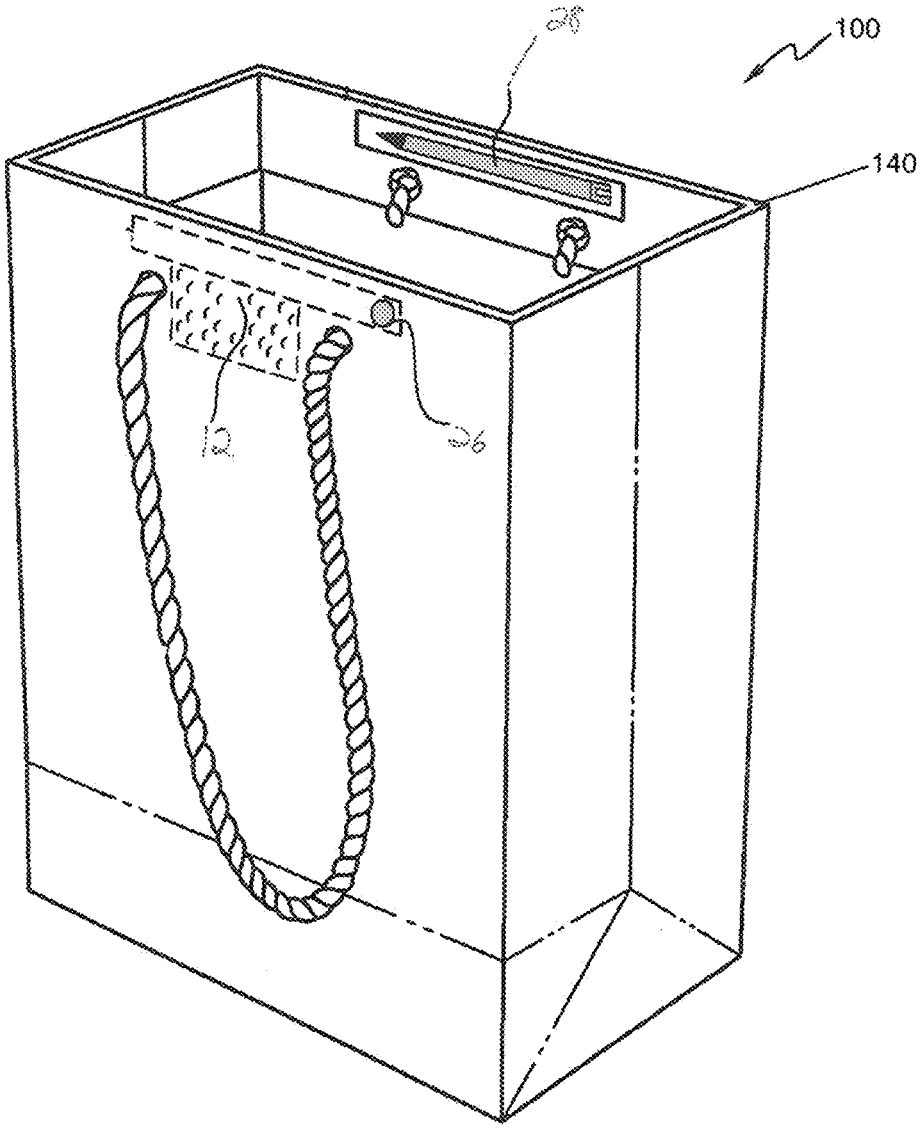
FIG. 6 is an alternate embodiment of the bag with an actuator for activating the insert.

Another manner of connecting the insert 12 for ejecting the material 14 during opening of the bag 10 is illustrated in FIG. 6, and involves using an actuator. In this embodiment, the insert 12 is associated with an actuator comprising at least one aperture 26 and a projection 28 for insertion therein. Upon opening of the gift bag 10, the projection 28 may thus engage and rupture the insert 12, thereby releasing the contents. The projection 28 may be in the form of a hook or other insertable structure, and may comprise metal, wood, plastic, or any other sturdy material. In one possible approach, the projection 28 may be flexible in order to facilitate the insertion into the aperture 26. In another possible approach, the projection 28 may be rigid, such that the walls 10*a*, 10*b* of the bag 10 may be bent or otherwise manipulated in order to insert the projection 28 into the aperture 52. In this manner, the gift bag 10 may be closed, with the projection 28 in engagement with the insert 12. As can be appreciated, a plurality of apertures and associated extensions may be provided so as to strategically control the ejection of the material 14.

This disclosure also pertains to a method of making a gift container, such as the above-described gift bag 10. The method may include the step of forming an insert 12 for placement in the bag 10, such as by folding and sealing a sheet of material 22 with a particulate material 14 therein. The insert 12 once formed and sealed may be attached to an interior of the gift bag 10, such as via an adhesive, to a first wall 10*a* of the bag 10. The method may include providing a connector, such as adhesive strip 16, for sealing the insert 12 to the second wall 10*b* of the bag 10.

In one aspect, the forming of the insert 12 may include attaching a single sheet of material 22 to an interior surface of one sidewall 10*a* of the bag 10 to form a compartment. This may include providing particulate material 14, such as glitter or confetti, within the compartment. The attaching may comprise sealing the sheet 22 with an adhesive to one wall of the bag 10, such as the sidewall 10*a*. Adhesive may be applied to the sheet of material 22 and/or to the side wall 10*a*, such as along at least one, but up to every edge of the sheet of material to seal the material thereto.

In another aspect, the forming of the insert 12 may include folding a sheet of material 22 to form opposing sheets for containing the contents, such as particulate material 14, therebetween. The opposing edges of the sheet of material may be folded and/or sealed to one another to form the compartment for containing the material 14. A top portion of the insert 12 may be sealed, such as by applying an adhesive thereto, for retaining the material 14. The insert 12 may be attached to the interior surface of the first wall 10*a*, such as along the upper portion. The remaining portions of the insert 12 (i.e. portions other than the top portion) may be attached to the first side, or may be free to move relative to the first wall 10*a*. The sealing of the upper or top portion of the insert 12 may be done before or after attachment to the interior of the first wall 10*a*.

While the disclosure presents certain embodiments to illustrate the inventive concepts, numerous modifications, alterations, and changes to the described embodiments are possible without departing from the sphere and scope of the present invention, as defined herein. For example, the insert may he included with the gift bag in any stage of formation. The insert 12 may be provided with, but not attached to, the gift container or bag 10, at the point of sale, such as for assembly by the purveyor of the gift, or may be distributed as a separate component for later use in connection with a gift bag. Additionally, the insert 12 may be provided unsealed, thereby allowing a user to add contents of his/her choice to the insert prior to sealing and/or attaching the insert within the gift bag 10. While a bag 10 is one possible implementation, the disclosure may pertain to other types of gift containers, including for example rigid or semi-rigid containers with removable lids, or even envelopes. Furthermore, the handles H could be replaced by pulls or other structures for causing the sidewalls 10*a*, 10*b* to separate or otherwise for opening the container. The term gift is also to be interpreted broadly, and is not intended to limit the contents of the outer container or bag 10 to any particular form. Accordingly, it is intended that the present disclosure not be limited to the described embodiments, but that it has the full scope defined by the language of the following claims, equivalents thereof, and that which is in the purview of the ordinarily skilled artisan upon examination of the disclosure.

The invention claimed is:

1. An apparatus for containing a gift, comprising:

an outer container including an open condition for receiving the gift and a closed condition for concealing the gift in the outer container; and an insert for containing a particulate material, the insert adapted for attaching to the outer container so as to release the particulate material upon movement of the outer container from the closed condition to the open condition;

wherein the outer container comprises a flexible bag having a plurality of sidewalls and a bottom wall opposite an open end for receiving the gift.

2. The apparatus of claim 1, wherein the insert is adapted to be attached to an interior surface along an upper portion of a sidewall of the outer container.

3. The apparatus of claim 1, wherein the insert comprises a sheet adapted to be attached to opposed interior surfaces of the outer container, said sheet forming a compartment for retaining the particulate material prior to the movement of the outer container to the open condition and for ejecting the particulate material from the compartment upon movement of the outer container to the open condition.

4. The apparatus of claim 3, further including at least one crease in the sheet.

5. The apparatus of claim 1, wherein the insert is formed of a first material and the outer container is formed of a second material, and wherein the first material has a lower tensile strength than the second material.

6. The apparatus of claim 1, further including a connector for connecting the insert to the outer container.

7. The apparatus of claim 6, wherein the connector comprises an adhesive on the insert for attaching at least one side of the outer container to the insert.

8. The apparatus of claim 6, wherein the connector comprises a strip of double sided tape including a liner covering an adhesive for adhering the insert to the outer container.

9. The apparatus of claim 6, wherein the connector comprises a projection for connecting to the insert.

10. A blank for forming the outer container for the apparatus of claim 1.

11. An apparatus for containing a gift, comprising:

an outer container having an open condition for receiving the gift and a closed condition for concealing the gift, the outer container comprising opposing sidewalls; and an ejector attached to the outer container and containing a particulate material, the ejector adapted for ejecting the particulate material toward the opening upon movement of the opposing sidewalls during movement of the outer container from the closed condition to the open condition to retrieve the gift through the opening;

wherein the outer container comprises a flexible bag, and the ejector comprises a flexible packet attached to an upper interior portion of the flexible bag.

12. The apparatus of claim 11, wherein the ejector is attached to the opposing sidewalls of the outer container along an upper portion thereof, and maintains the sidewalls in the closed condition prior to movement to the open condition.

13. The apparatus of claim 11, wherein a first side of the ejector is attached to at least one of the sidewalls of the outer container, and further including a connector for connecting a second side of the ejector to another sidewall of the outer container.

14. The apparatus of claim 11, wherein the particulate material comprises one or more of glitter, confetti, beads, gems, precious stones, semi-precious stones, or crystals.

15. A method of providing a gift, comprising:

during opening of an outer container from a closed condition concealing the gift therein, ejecting a particulate material from an insert within the outer container;

wherein the outer container comprises a flexible bag having an open end and the insert comprises an ejector comprising a flexible packet including the particulate material, and wherein the opening of the outer container comprises separating opposing sidewalls of the flexible bag to which the flexible packet is attached such that the visually appealing content is ejected toward the open end.

16. The method of claim 15, further including the step of attaching the outer container to the ejector.

17. The method of claim 15, further including the step of sealing the outer container with the gift and the ejector therein.

* * * * *